US008388101B2

(12) United States Patent
Shimazaki

(10) Patent No.: US 8,388,101 B2
(45) Date of Patent: Mar. 5, 2013

(54) LIQUID EJECTION DEVICE

(75) Inventor: Jun Shimazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 13/023,034

(22) Filed: Feb. 8, 2011

(65) Prior Publication Data

US 2011/0199423 A1 Aug. 18, 2011

(30) Foreign Application Priority Data

Feb. 15, 2010 (JP) ..... 2010-030431

(51) Int. Cl.
*B41J 2/165* (2006.01)

(52) U.S. Cl. ..... 347/29

(58) Field of Classification Search ..... 347/29, 347/30, 31, 36
See application file for complete search history.

(56) References Cited

U.S. PATENT DOCUMENTS 6,623,098 B2 * 9/2003 Davis ..... 347/29
7,517,047 B2 * 4/2009 Kambe ..... 347/29
2006/0214981 A1 9/2006 Fukasawa et al.

FOREIGN PATENT DOCUMENTS

JP 2007-152926 A 6/2007

* cited by examiner

*Primary Examiner* — Lamson Nguyen
(74) *Attorney, Agent, or Firm* — Global IP Counselors, LLP

(57) ABSTRACT

A liquid ejection device includes a liquid ejection head and a capping mechanism. The liquid ejection head includes nozzles for ejecting a dispersion liquid having charged solid particles dispersed in a dispersion medium. The capping mechanism covers the nozzles and receiving the liquid. The capping mechanism includes a cap member, a solid/liquid separation chamber, and a waste liquid tank. The cap member is configured to receive the liquid discharged through the nozzles. The solid/liquid separation chamber is configured to store the liquid and to separate the liquid into the solid particles and the dispersion medium. The dispersion medium separated from the solid particles flows into the waste liquid tank. The solid/liquid separation chamber has a pair of electrodes in contact with the liquid stored therein so that voltage is applied to the electrodes to allow the solid particles to precipitate on a surface of one of the electrodes.

8 Claims, 3 Drawing Sheets

LIQUID EJECTION DEVICE

CROSS-REFERENCE TO RELATED APPLICATIONS

This application claims priority to Japanese Patent Application No. 2010-030431 filed on Feb. 15, 2010. The entire disclosure of Japanese Patent Application No. 2010-030431 is hereby incorporated herein by reference.

BACKGROUND

1. Technical Field

The present invention relates to a liquid ejection device.

2. Related Art

An inkjet printer (hereinafter referred to as a "printer") is well known as a liquid ejection device that ejects ink droplets (liquid) onto a recording sheet (medium). In a printer of this type, evaporation of ink through nozzles formed in a recording head causes the following problems: The viscosity of the ink increases; the ink itself solidifies; dust and dirt adhere to the recording head; and air bubbles that enter the nozzles clog them. These are all problematic because they cause printing failure.

To address these problems, a typical printer is designed to prevent the nozzles from becoming clogged by performing, separately from ink ejection onto a recording sheet, flushing actions, in which ink in the nozzles is ejected, for example, in a period between printing actions (when no printing is performed), as well as sucking actions, in which ink is forcibly sucked through the nozzles.

The ink discharged in the flushing or the sucking actions is stored in a waste liquid tank. An upper opening of the waste liquid tank communicates with the atmosphere, and the stored waste ink gradually evaporates and decreases in volume. The capacity of the waste liquid tank is therefore typically designed in consideration of the amount of waste ink evaporating when the printer is in use. Specifically, the actual capacity of the waste liquid tank is designed to be smaller than an acceptable capacity thereof. This allows the size of the printer to be reduced.

In recent years, because users tend to place a higher priority on the durability and luminescence of ink, pigment ink, which excels dye ink in durability and luminescence, has been used. Pigment ink contains pigment particles dispersed in water or any other suitable dispersion medium and has high reflected density on printed matter, that is, it excels in image quality on plain paper, while also being more volatile and easier to solidify than dye ink.

In a printer using pigment ink, the dispersion medium evaporates from waste ink discharged into the waste liquid tank, resulting in pigment precipitation and deposition in the waste liquid tank. In some cases this pigment deposition causes problems, for example, by blocking a discharge port of a flow path through which waste ink is guided into the waste liquid tank. To address these problems, Japanese Patent Laid-Open Publication No. 2007-152926 proposes a configuration in which air is sprayed on the deposited pigment in the waste liquid tank so that the pigment deposit is blown off.

SUMMARY

Since the method described above, however, does not inherently inhibit the deposition of pigment in the waste liquid tank, the problems may not be solved.

For example, as shown in FIG. 3, in a waste liquid tank 100 including an absorber 101 that absorbs waste ink, pigment X having precipitated clogs the absorber 101. As a result, the absorber 101 does not absorb waste ink very effectively, and the acceptable capacity of the waste liquid tank decreases accordingly. Because the pigment that clogs the inside of the absorber 101 cannot be removed by spraying air in the configuration described in Japanese Patent Laid-Open Publication No. 2007-152926, the problems cannot be solved.

Because the evaporation of the dispersion medium of the ink causes the precipitation of pigment, the problems due to pigment precipitation can be solved by enclosing the waste liquid tank 100 to inhibit the evaporation of the dispersion medium. The waste liquid tank of related art, however, has been reduced in size in consideration of the evaporation of the solvent medium. If no dispersion medium evaporates, the acceptable capacity of the waste liquid tank decreases. The acceptable capacity can be increased by increasing the size of the waste liquid tank, but in this case the size of the apparatus disadvantageously increases.

The invention has been made in view of the circumstances described above. An object of the invention is to provide a liquid ejection device including a configuration, in which a pigment and a dispersion medium in a pigment ink are separated from each other so that only the dispersion medium can be primarily stored in a waste liquid tank, capable of inhibiting precipitation of the pigment in the waste liquid tank.

To achieve the object described above, a liquid ejection device according to one aspect of the present invention includes a liquid ejection head and a capping mechanism. The liquid ejection head includes nozzles for ejecting a liquid that is a dispersion liquid having charged solid particles dispersed in a dispersion medium. The capping mechanism covers the nozzles and receives the liquid. The capping mechanism includes a cap member configured to receive the liquid discharged through the nozzles. The solid/liquid separation chamber is configured to store the liquid flowing from the cap member and to separate the liquid into the solid particles and the dispersion medium. The dispersion medium separated from the solid particles flows into the waste liquid tank. The solid/liquid separation chamber has a pair of electrodes in contact with the liquid stored therein so that voltage is applied to the electrodes to allow the solid particles to precipitate on a surface of one of the electrodes.

According to this configuration, waste liquid (liquid) containing solid particles is separated into the solid particles and the dispersion medium in the solid/liquid separation chamber before flowing into the waste liquid tank, and only the dispersion medium is in principle discharged into the waste liquid tank. The liquid ejection device can therefore be configured in such a manner that the problems due to the precipitation of the solid particles in the waste liquid tank are inhibited.

In the liquid ejection device as described above, the electrodes preferably face each other and are oriented upright with respect to a bottom of the solid/liquid separation chamber.

According to this configuration, even when the solid particles having precipitated on one of the electrodes separate from the surface of the electrode, the solid particles will not deposit on the surface of the other electrode but will deposit on the bottom of the solid/liquid separation chamber, whereby solid/liquid separation can be stably performed without contamination of the surface of the other electrode.

In the liquid ejection device as described above, the solid/liquid separation chamber preferably includes a first chamber in which one of the electrodes on which the solid particles precipitate is disposed and a second chamber in which the other of the electrodes on which solid particles do not precipitate is disposed. The first chamber and the second chamber being in communication with each other. The second chamber preferably includes a discharge path through which the dispersion medium is discharged from the solid/liquid separation chamber to the waste liquid tank at the bottom of the second chamber.

According to this configuration, the solid particles, having separated from the surface of the corresponding electrode, will not be discharged into the waste liquid tank.

In the liquid ejection device as described above, the bottom of the first chamber is preferably deeper than the bottom of the second chamber.

According to this configuration, because the solid particles, having separated from the surface of the corresponding electrode, deposit on the deeper portion of the bottom of the solid/liquid separation chamber, it will take longer for the deposit on the bottom to interfere with the electrode, whereby the solid/liquid separation can take place for a longer period of time.

In the liquid ejection device as described above, the solid/liquid separation chamber preferably further has a removal unit configured to wipe a surface of the one of the electrodes to remove the solid particles.

According to this configuration, because the surface of the electrode in question can be always exposed and a voltage can be applied in such a manner that electrophoresis takes place in a satisfactory manner, reliable solid/liquid separation becomes possible.

In the liquid ejection device as described above, the liquid ejection device preferably further has a controller configured to control application of voltage to the electrodes. The controller is preferably configured to apply voltage to the electrodes when an amount of liquid stored in the solid/liquid separation chamber exceeds an amount of liquid at which the liquid contacts the electrodes.

According to this configuration, the solid/liquid separation process can be reliably performed in the solid/liquid separation chamber.

In the liquid ejection device as described above, the controller is preferably configured to apply voltage to the electrodes when the amount of liquid stored in the solid/liquid separation chamber exceeds the amount of liquid at which the liquid contacts the electrodes and a predetermined threshold that is greater than the amount of liquid at which the liquid contacts the electrodes.

According to this configuration, because the solid/liquid separation is not performed until the amount of liquid stored in the solid/liquid separation chamber reaches at least the threshold, the number of solid/liquid separations to be performed can be reduced and the process can be performed efficiently. Further, because the solid/liquid separation occurs when the threshold is reached, the process can be performed before the liquid spills over the solid/liquid separation chamber, and the processed liquid can be discharged into the waste liquid tank.

In the liquid ejection device as described above, the solid/liquid separation chamber preferably further has a stirring unit configured to stir the liquid stored therein.

In this configuration, the solid particles are made to flow in addition to the motion produced by electrophoresis, facilitating the precipitation.

BRIEF DESCRIPTION OF THE DRAWINGS

Referring now to the attached drawings which form a part of this original disclosure.

DETAILED DESCRIPTION OF EXEMPLARY EMBODIMENTS

A liquid ejection device according to an embodiment of the invention will be described below with reference to FIGS. 1 and 2. In all the following drawings, the dimensions and proportions of components differ as required for ease of illustration.

Figure 1:
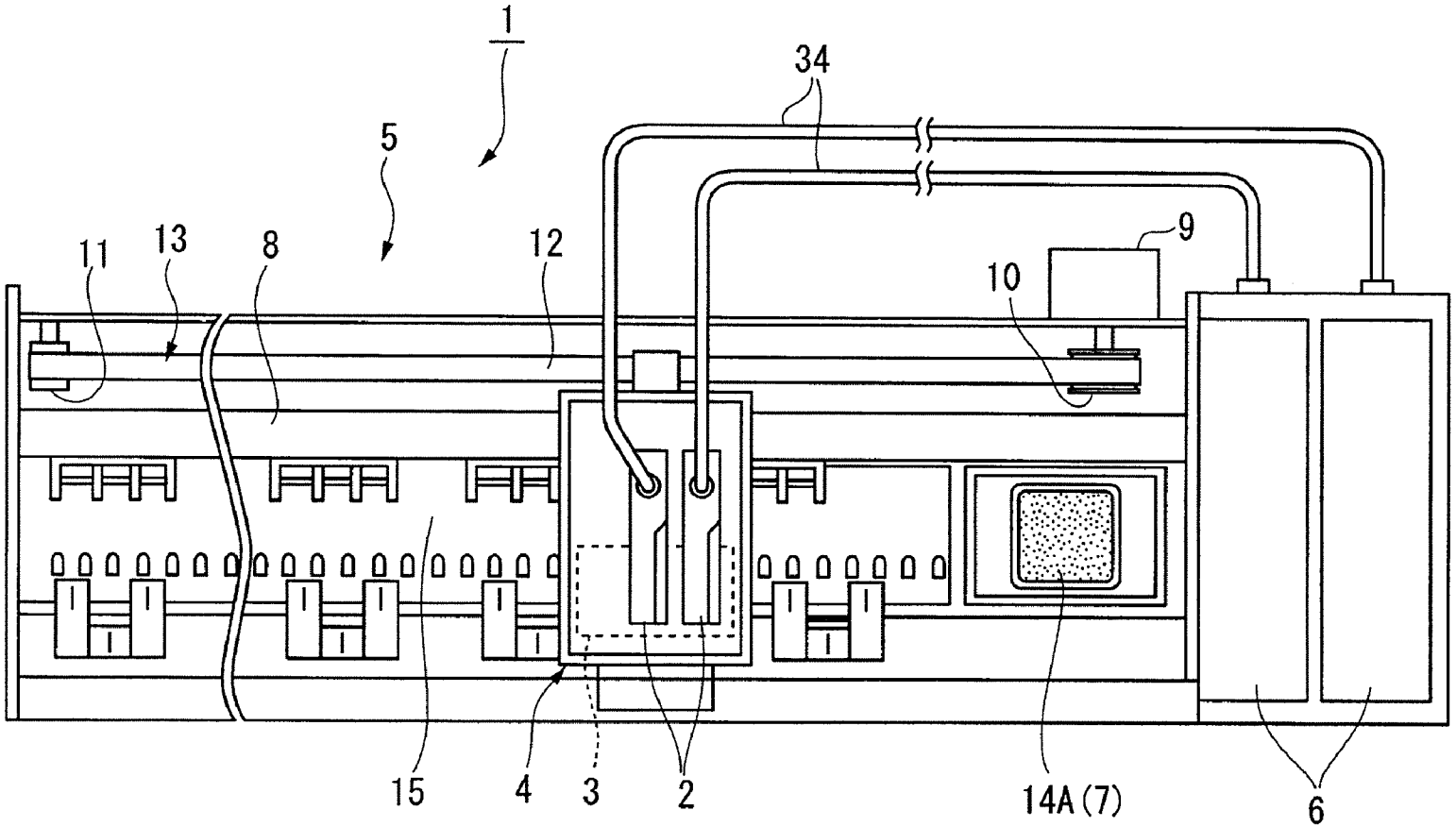
FIG. 1 is a partial view showing a schematic configuration of a printer according to an embodiment of the invention.

FIG. 1 is a partial view showing a schematic configuration of a printer (liquid ejection device) 1 according to an embodiment of the invention. The printer 1 generally has a carriage 4 in which sub-tanks 2 and a recording head 3 are incorporated, and a printer body 5. The printer body 5 is provided with a carriage translation mechanism 13 that translates the carriage 4 in reciprocating motion, a sheet feed mechanism that transports a recording sheet (not shown), a capping mechanism 14A used to clean or otherwise treat the recording head (ejection head) 3, and ink cartridges 6 that store ink supplied to the recording head 3 through supply tubes 34.

The ink cartridge 6 stores a pigment ink. The pigment ink contains pigment particles (solid particles) that are insoluble in water or organic solvents and used to color ink, a dispersion medium that disperses the pigment, a surfactant for stabilizing the dispersion system, and other materials.

The capping mechanism 14A includes an ink droplet sensor 7 capable of detecting an ink droplet discharged from the recording head 3. The ink droplet sensor 7 can sense how well ink is ejected through the nozzles, specifically, by charging ink droplets discharged through the nozzles in the recording head 3 and outputting a detection signal representing the change in voltage based on electrostatic induction that occurs when the charged ink droplets fly.

The carriage translation mechanism 13 includes a guide shaft 8 extending in the width direction of the printer body 5, a pulse motor 9, a drive pulley 10 connected to a rotating shaft of the pulse motor 9 and rotated by the pulse motor 9, a driven pulley 11 provided on the opposite side to the drive pulley 10 in the width direction of the printer body 5, and a timing belt 12 extending between the drive pulley 10 and the driven pulley 11 and connected to the carriage 4.

The carriage 4 is configured to make reciprocating motion in a primary scan direction along the guide shaft 8 when the pulse motor 9 is driven. The sheet feed mechanism includes a sheet feed motor (not shown) and a sheet feed roller (not shown) rotated by the sheet feed motor, and successively feeds recording sheets onto a platen 15 in synchronization with recording (character and graphic printing) action.

Figure 2:
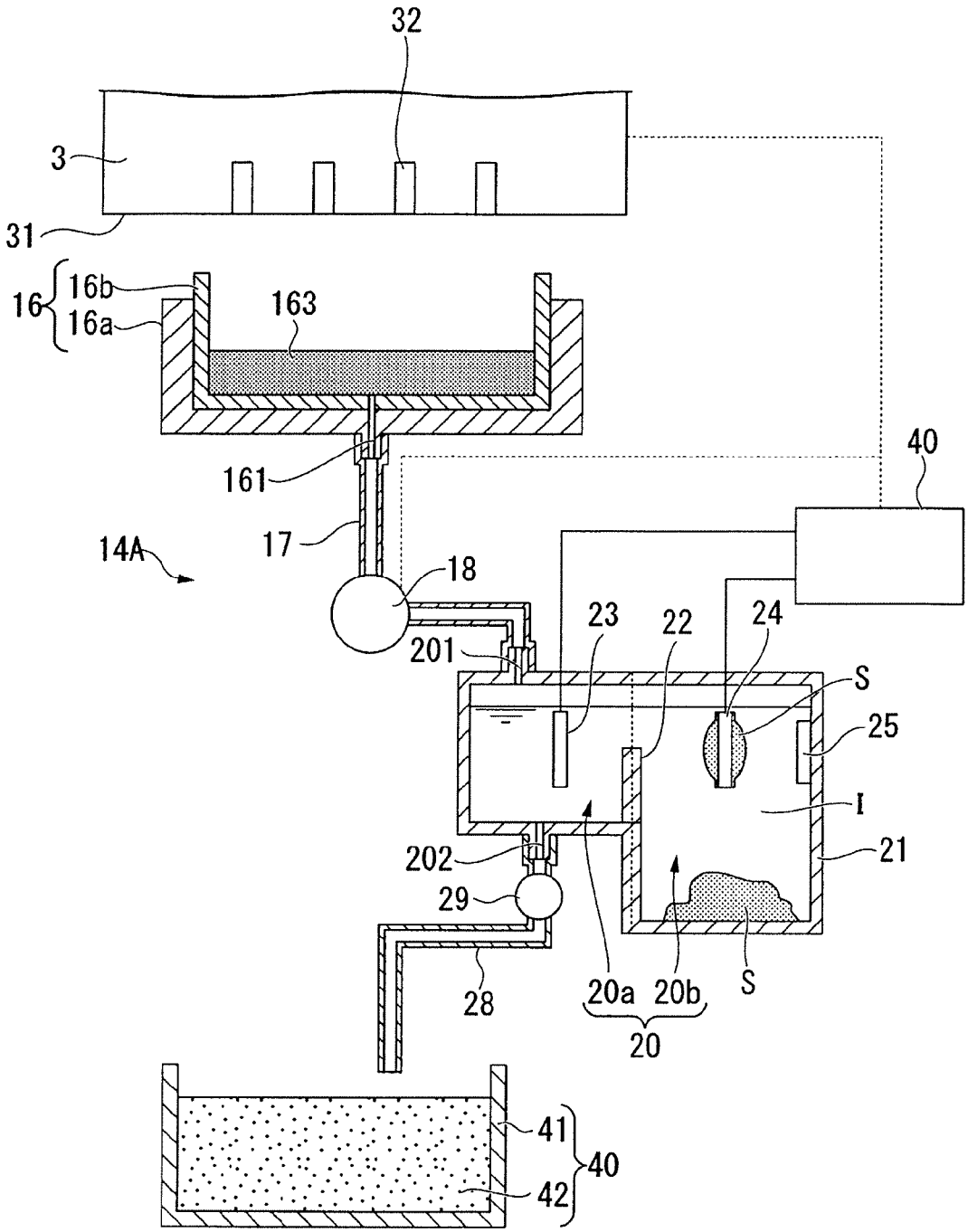
FIG. 2 is a descriptive diagram showing a capping mechanism in the present embodiment.
Figure 3:
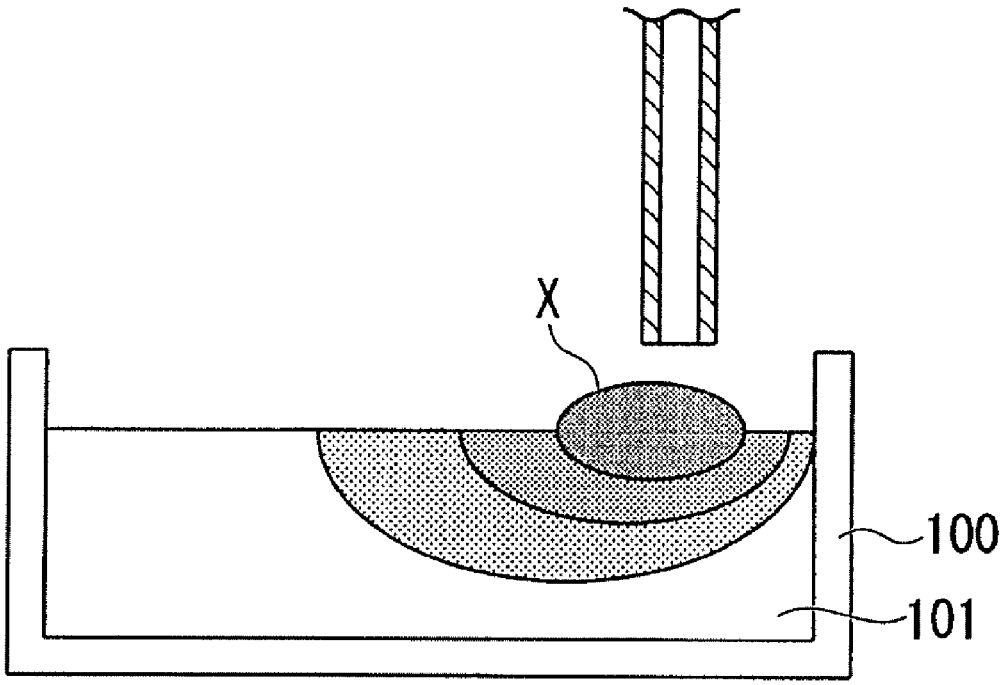
FIG. 3 is a descriptive diagram showing a problem in related art.

FIG. 2 is a descriptive diagram showing the capping mechanism 14A in the present embodiment. As shown in FIG. 2, the capping mechanism 14A has a cap (cap member) 16 that covers the openings of nozzles 32, a separation chamber (solid/liquid separation chamber) 20 that temporarily stores waste pigment ink I discharged into the cap 16 and separates the pigment and the dispersion medium from each other, and a waste liquid tank 40 into which the separated dispersion medium is discharged.

The cap 16 includes a cap holder 16*a* and a cap member 16*b*. The cap holder 16*a* has a box-like shape with an upper opening facing a nozzle formation surface 31 of the recording head 3. The cap member 16*b* is made of elastomer or any other flexible material and supported by the inner wall of the cap holder 16*a*. The upper edge of the cap member 16*b* protrudes upward beyond the upper edge of the cap holder 16*a*. The cap 16 is attached movably upward and downward when driven by a drive motor or any other suitable lifting device (not shown).

An ink absorber 163, having a sheet-like shape and made of sponge or any other similar material, is accommodated in the cap member 16*b* on the bottom surface thereof. The ink absorber 163 receives and temporarily absorbs ink discharged from the recording head 3. When the cap 16 seals the nozzle formation surface 31, the solvent of the absorbed ink volatilizes into a space formed by the nozzle formation surface 31 and the cap 16, and it is possible to prevent the openings of the nozzles 32 from drying out.

An ink discharge port (discharge path) 161 is formed through the bottom of the cap 16 and connected to a pipe 17. The pipe 17 connects the cap 16 to the separation chamber 20, and a sucking pump 18 is connected to a middle portion of the pipe 17. The sucking pump 18 can be a typically known tube pump.

The sucking pump 18, when driven with the cap 16 sealing the nozzle formation surface 31, sucks ink from each of the nozzles 32. The sucking action prevents the nozzles 32 from being clogged.

The waste ink sucked by the sucking pump 18 flows into the separation chamber 20 through a supply port 201 formed through the separation chamber 20 and connected to the pipe 17. The separation chamber 20 has a body 21 that stores waste ink I, a wall 22 that is provided in the body 21 and divides the interior thereof into two spaces that communicate with each other, a pair of electrodes 23 and 24, and an agitator 25 that stirs the waste ink I stored in the separation chamber 20.

The wall 22 stands upright from the bottom of the body 21, and the two spaces divided by the wall 22 respectively form first and second chambers in this embodiment. In FIG. 2, reference numeral 20*a* denotes the first chamber, and reference numeral 20*b* denotes the second chamber. The bottom of the second chamber 20*b* is deeper than that of the first chamber 20*a*. Alternatively, the bottom of the first chamber 20*a* and the bottom of the second chamber 20*b* may be at the same level.

The pair of electrodes 23 and 24 face each other and are disposed in the first chamber 20*a* and the second chamber 20*b*, respectively. The pair of electrodes 23 and 24 are oriented upright toward the bottom of the body 21. The waste ink I stored in the body 21 is in contact with the electrodes 23 and 24. When a voltage is applied to the pair of electrodes 23 and 24 in response to an instruction from a controller 50, the voltage is then applied to the stored waste ink I and the pigment undergoes electrophoresis.

The surfaces of the pigment particles contained in the waste ink I have been charged for a variety of reasons. For example, when a cationic surfactant is used to stabilize the dispersion of the pigment in the waste ink I, the cationic surfactant adheres to the surface of the pigment particles and positively charges the surface. When a voltage is applied to the waste ink I while it is stored in this manner, in such a way that the electrode 23 serves as an anode and the electrode 24 serves as a cathode, the resultant electric field causes the pigment in the waste ink I to undergo electrophoresis and move toward the electrode 24, deposit on the surface of the electrode 24, and form deposit S, as shown in FIG. 2. The separation chamber 20 thus separates the pigment and the dispersion medium from the waste ink I.

The agitator 25 provided on the side wall of the separation chamber 20 produces convection of the waste ink I stored in the separation chamber 20. As a result, a force, in addition to the force produced by the electrophoresis, acts on the pigment in such a way that the pigment flows toward the electrode 24, which facilitates the precipitation of the pigment on the surface of the electrode 24.

When the voltage application to the electrodes is terminated, the deposit S on the surface of the cathode separates from the cathode and falls onto the bottom of the body 21. The electrode 24, where the deposit S is formed, is disposed in the second chamber 20*b*, which has a greater depth, whereby a greater amount of deposit S can be stored on the bottom of the second chamber 20*b*.

To reliably remove the deposit S from the surface of the electrode 24, a wiper that moves relative to the surface of the electrode 24 may be provided to wipe the surface of the electrode 24. This configuration allows the surface of the electrode 24 to be exposed and kept in a state in which electrophoresis is likely to occur.

In this kind of separation chamber 20, it is necessary to immerse the electrodes 23 and 24 in the waste ink I in order for solid/liquid separation operations to occur. Further, it is not efficient to perform solid/liquid separation during the flushing or sucking actions of the recording head 3. Therefore, in the separation chamber 20 of the present embodiment, when the amount of waste ink I reaches a point where the waste ink I reliably comes into contact with the electrodes 23 and 24, solid/liquid separation based on electrophoresis is performed. More specifically, when the amount of waste ink I stored in the separation chamber 20 exceeds a predetermined threshold, solid/liquid separation is performed. The timing at which a voltage is applied to the electrodes is controlled by the controller 50.

For example, solid/liquid separation may be performed by detecting the amount of ink discharged from the recording head 3 into the cap 16 in the flushing process. In this case, the solid/liquid separation process is performed when the total amount of discharged ink exceeds a predetermined threshold. As an alternative, solid/liquid separation may be performed by detecting the amount of waste ink discharged by the sucking pump 18. In this case, the process is performed when the detected amount of waste ink exceeds a threshold. As another alternative, solid/liquid separation may be performed by providing a detector in the separation chamber 20 that detects the amount of waste ink I stored therein. In this case, the process is performed when the detected amount of stored waste ink I exceeds a threshold.

A discharge port 202 connected to a pipe 28 is provided through the bottom of the first chamber 20*a*, and a valve 29 that can be arbitrarily opened and closed is provided at a point somewhere along the path of the pipe 28. When the pigment is separated from the waste ink I, the valve 29 is opened and the separated dispersion medium is discharged through the discharge port 202 toward a waste liquid tank 40.

The waste liquid tank 40 has a box-shaped housing 41 with an upper opening and an absorber 42 provided in the housing 41. The dispersion medium discharged into the waste liquid tank 40 is absorbed and held by the absorber 42, gradually evaporates, and hence decreases in volume.

Because the pigment has been removed from the dispersion medium to be discharged into the waste liquid tank 40, it is unlikely that pigment will precipitate from the evaporation of the dispersion medium, thereby clogging the absorber 42. It is conceivable that the separation chamber 20 cannot completely remove the pigment and a certain amount of pigment may be left in the discharged dispersion medium, but the discharged dispersion medium is less likely to clog the absorber than the initial waste ink I because the amount of pigment contained in the discharged dispersion medium has decreased.

It is therefore possible to design the waste liquid tank 40 with the decrease in volume of the dispersion medium due to evaporation in mind; the waste liquid tank 40 can be designed to be smaller and the capping mechanism 14A can be correspondingly configured to be compact.

The capping mechanism 14A provided in the printer of the present invention has the configuration described above.

If the printer 1 includes the capping mechanism configuration described above, the waste ink I containing pigment is separated in the separation chamber 20 into pigment and the dispersion medium before entering the waste liquid tank 40, and in principle only the dispersion medium is discharged into the waste liquid tank 40. The printer 1 can therefore be configured in such a way that the problems due to pigment precipitating in the waste liquid tank 40 are inhibited.

In the present embodiment, the printer 1 is presented as a liquid ejection device, and pigment ink is presented as the liquid ejected by the printer 1. The invention is not limited thereto, and is applicable to an apparatus that ejects liquid containing metal particles or inorganic particles in accordance with applications for other purposes.

In the present embodiment, the pair of electrodes 23 and 24 face each other in the separation chamber 20 and are oriented upright toward the bottom of the separation chamber 20. Different configurations in which the pair of electrodes 23 and 24 is immersed in the waste ink I can be employed because applying a voltage to the electrodes allows the pigment to undergo electrophoresis and the waste ink I can effectually undergo solid/liquid separation in the separation chamber 20.

In the present embodiment, the pair of electrodes 23 and 24 are disposed in the first chamber 20*a* and the second chamber 20*b*, respectively. Different configurations in which the pair of electrodes 23 and 24 is immersed in the waste ink I can be employed because the waste ink I can effectually undergo solid/liquid separation in the separation chamber 20.

In the present embodiment, a threshold is set for the amount of waste ink stored in the separation chamber 20, and the solid/liquid separation process is performed in the separation chamber 20 when the amount of waste ink exceeds the threshold. Alternatively, a user of the printer may arbitrarily issue an instruction to perform the solid/liquid separation process.

In the present embodiment, the agitator 25 is provided to stir the waste ink I in the separation chamber 20, but the agitator 25 may be omitted.

A preferred embodiment according to the invention has been described above with reference to the accompanying drawings, but the invention is, of course, not limited to the embodiment. The shapes of the components, combinations thereof, and other parameters described in the above embodiment have been presented by way of example, and a variety of changes can be made based on design and other requirements to the extent that the changes do not depart from the substance of the invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a liquid ejection head including nozzles for ejecting a liquid that is a dispersion liquid having charged solid particles dispersed in a dispersion medium; and a capping mechanism covering the nozzles and receiving the liquid, the capping mechanism including a cap member configured to receive the liquid discharged through the nozzles, a solid/liquid separation chamber configured to store the liquid flowing from the cap member and to separate the liquid into the solid particles and the dispersion medium, and a waste liquid tank into which the dispersion medium separated from the solid particles flows, the solid/liquid separation chamber having a pair of electrodes in contact with the liquid stored therein so that voltage is applied to the electrodes to allow the solid particles to precipitate on a surface of one of the electrodes.

2. The liquid ejection device according to claim 1, wherein the electrodes face each other and are oriented upright with respect to a bottom of the solid/liquid separation chamber.

3. The liquid ejection device according to claim 2, wherein the solid/liquid separation chamber includes a first chamber in which one of the electrodes on which the solid particles precipitate is disposed and a second chamber in which the other of the electrodes on which solid particles do not precipitate is disposed, the first chamber and the second chamber being in communication with each other, and the second chamber includes a discharge path through which the dispersion medium is discharged from the solid/liquid separation chamber to the waste liquid tank at the bottom of the second chamber.

4. The liquid ejection device according to claim 2, wherein the bottom of the first chamber is deeper than the bottom of the second chamber.

5. The liquid ejection device according to claim 2, wherein the solid/liquid separation chamber further has a removal unit configured to wipe a surface of the one of the electrodes to remove the solid particles.

6. The liquid ejection device according to claim 1, wherein the liquid ejection device further has a controller configured to control application of voltage to the electrodes, the controller being configured to apply voltage to the electrodes when an amount of liquid stored in the solid/ liquid separation chamber exceeds an amount of liquid at which the liquid contacts the electrodes.

7. The liquid ejection device according to claim 6, wherein the controller is configured to apply voltage to the electrodes when the amount of liquid stored in the solid/liquid separation chamber exceeds the amount of liquid at which the liquid contacts the electrodes and a predetermined threshold that is greater than the amount of liquid at which the liquid contacts the electrodes.

8. The liquid ejection device according to claim 1, wherein the solid/liquid separation chamber further has a stirring unit configured to stir the liquid stored therein.

* * * * *